US008225759B2

(12) United States Patent
Wutzler et al.

(10) Patent No.: US 8,225,759 B2
(45) Date of Patent: Jul. 24, 2012

(54) VALVE DRIVE FOR ACTIVATION OF GAS EXCHANGE VALVES OF INTERNAL COMBUSTION ENGINES

(75) Inventors: Joerg Wutzler, Zwickau (DE); Andreas Werler, Zwickau (DE); Heiko Neukirchner, Chemnitz (DE); Joerg Ross, Castelvetro (IT)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 421 days.

(21) Appl. No.: 12/653,145

(22) Filed: Dec. 9, 2009

(65) Prior Publication Data

US 2010/0139594 A1 Jun. 10, 2010

(30) Foreign Application Priority Data

Dec. 10, 2008 (DE) ..... 10 2008 061 440

(51) Int. Cl.
*F01L 1/34* (2006.01)

(52) U.S. Cl. ..... 123/90.16; 123/90.18; 123/90.15

(58) Field of Classification Search ..... 123/90.15, 123/90.16, 90.18, 90.31
See application file for complete search history.

(56) References Cited

U.S. PATENT DOCUMENTS 6,425,359 B2 * 7/2002 Fujii et al. ..... 123/90.18

FOREIGN PATENT DOCUMENTS

| | | |
|---|---|---|
| DE | 35 20 859 | 12/1986 |
| DE | 42 30 877 | 4/1993 |
| DE | 195 19 048 | 11/1996 |
| DE | 195 20 117 | 12/1996 |
| DE | 100 54 623 | 5/2002 |
| DE | 10 2004 033 798 | 2/2006 |
| DE | 10 2004 055 852 | 4/2006 |
| DE | 10 2007 010 157 | 6/2008 |
| JP | 2-016312 | 1/1990 |
| JP | 3-003907 | 1/1991 |

* cited by examiner

*Primary Examiner* — Zelalem Eshete
(74) *Attorney, Agent, or Firm* — Collard & Roe, P.C.

(57) ABSTRACT

A valve drive for activation of gas exchange valves of internal combustion engines, with which valve stroke switching is accomplished with little effort, a low construction height, and at low switching forces. Incorrect switching and damage to the camshaft during valve stroke switching are avoided, even at high engine speeds of rotation. An adjustment shaft that is rotatable by the camshaft and parallel to the camshaft has two adjustment devices rotatably disposed on it, along with two tappets between the adjustment devices. The tappets are connected with a shift gate for valve switching between two different cam profiles of a cam package that is axially displaceable on the camshaft. The tappets each have a contour that contacts the adjustment devices via a guide pin. A gear wheel engages with a gear segment on the camshaft, via a drive on the adjustment shaft, to rotate the adjustment shaft.

16 Claims, 5 Drawing Sheets

VALVE DRIVE FOR ACTIVATION OF GAS EXCHANGE VALVES OF INTERNAL COMBUSTION ENGINES

CROSS REFERENCE TO RELATED APPLICATIONS

Applicant claims priority under 35 U.S.C. 119 of German Application No. 10 2008 061 440.8 filed Dec. 10, 2008.

BACKGROUND OF THE INVENTION

1. Field of the Invention

The invention relates to a valve drive for activation of gas exchange valves of internal combustion engines.

2. The Prior Art

It is known to operate gas exchange valves of an internal combustion engine variably with different opening and closing time points, as well as with different valve opening strokes. Such a valve control is described in German Patent Application No. DE 42 30 877 A1. In this connection, a camshaft block having two different cam contours is disposed on a camshaft so as to rotate with it, but in an axially displaceable manner. Depending on the axial position of the cam block, a cam contour stands in a functional connection with the stroke valve, by way of an intermediate element (transfer lever). The axial displacement of the cam block for changing the valve parameters takes place during the base circle phase, counter to the effect of a reset spring, by means of a pressure ring.

German Patent Application No. DE 35 20 859 A1 describes an internal combustion engine having at least one camshaft driven by a crankshaft, for activation of inlet and outlet valves. Two cams having different structures, in terms of their cam contour, and placed directly next to one another are disposed on the camshaft; these cams determine the opening and closing time point and the opening stroke in accordance with their configuration, taking the valve play into account. During passage through the cam base circle, which has the same shape in both cams, an adjustable intermediate piece is displaced, by way of a shift rod and a lever, in such a manner that optionally, one of the two cams can be brought into a functional connection with the valve.

German Patent Application No. DE 195 19 048 A1 describes a variable valve drive for an internal combustion engine, in which again, two cams having different structures, in terms of their cam contour, and placed directly next to one another are disposed on the camshaft. The change in cam engagement takes place by axial displacement of the camshaft with the cam situated on it.

Furthermore, a valve drive of an internal combustion engine is described in German Patent Application No. DE 195 20 117 C2, in which an axially displaceable cam block having at least two different cam paths is disposed on the camshaft, so as to rotate with it. The adjustment of the cam block takes place by way of an adjustment organ that is guided in the interior of the camshaft. The adjustment organ is displaced in the interior of the camshaft by a dual-action hydraulic or pneumatic piston/cylinder unit disposed on the face side of the camshaft. The adjustment organ is connected with an entrainment piece that penetrates an oblong hole disposed axially in the camshaft, and ends in a bore of the cam block.

German Patent Application No. DE 100 54 623 A1 describes a device for switching over a cam package on a camshaft, to activate gas exchange valves, in which the cam package is guided on the camshaft in an axially displaceable manner. The gas exchange valve is in a functional connection with different cam contours, in accordance with the position of the cam package. The adjustment of the cam package takes place by way of a setting element in interaction with a gate track. The setting element is a pin that can be displaced radially to the outside, which interacts, in the moved-out state, with at least two gate tracks formed in a guide part disposed around the cam package by approximately 180°.

A disadvantage of the cited prior art is the great need for construction space that is required to adjust the cam block. These solutions can therefore be used only in the case of relatively large cylinder distances, so that the corresponding components can be accommodated. Another disadvantage is the great mass forces that occur during the setting process, which are required for displacing the cam blocks or the adjustment organs. Switching to a corresponding cam contour can generally take place only cylinder-selectively with the solutions named in the prior art. Valve-selective switching is not possible.

A significant disadvantage of DE 100 54 623 A1 is that in order to switch to a different cam contour, the pin has to be moved out of the camshaft and tracked into an axially displaceable shift gate. After the switching process, the pin has to be moved back in again. This design is very parts-intensive and production-intensive, and there is the risk of damage to the camshaft, resulting from incorrect shifting of the pin. A further disadvantage is that the engine speed of rotation is limited because of the required adjustment time of the pin. Furthermore, the adjustment is dependent on the oil pressure that is present.

German Patent Application No. DE 10 2004 033 798 A1 describes a valve stroke switching mechanism for gas exchange valves in an internal combustion engine, between two different cam contours, by means of a shift gate disposed on the housing of the internal combustion engine so as not to rotate, but in an axially displaceable manner. The shift gate partly surrounds the camshaft and is provided with a gate groove that widens opposite to the direction of rotation of the camshaft, the side walls of which groove each form a gate flank that can be brought reciprocally into a functional connection with a contact surface disposed on an axially displaceable second cam contour, on both sides, laterally, in order to switch the valve stroke. During valve stroke switching, the axially displaceable second cam contour is either pushed over the cam contour of the cam that is firmly connected with the camshaft, by means of the shift gate, or pushed away from the cam contour, so that optionally, two different cam contours can be brought into a functional connection with the gas exchange valve.

SUMMARY OF THE INVENTION

It is therefore an object of the invention to create a valve drive of the type stated, for activation of gas exchange valves of internal combustion engines, with which valve stroke switching is carried out with little technical effort, a low construction height, and at low switching forces to be applied, whereby incorrect switching and damage to the camshaft during valve stroke switching are avoided even at high engine speeds of rotation.

According to the invention, this task is accomplished by a valve drive for activation of gas exchange valves of internal combustion engines, having at least one camshaft driven by the crankshaft of the internal combustion engine, axially displaceable cams disposed on the camshaft, which stand in a functional connection, directly or by way of intermediate elements, with the gas exchange valve, and a shift gate disposed on the housing of the internal combustion engine; in an axially displaceable manner. The gate is provided with a gate groove that widens counter to the direction of rotation of the camshaft, and which can be brought into a functional connection with contact surfaces of a displaceable cam contour, for valve stroke switching between at least two different cam profiles.

For activation of the valve stroke switching, an adjustment shaft that can be rotated by the camshaft is disposed parallel to the camshaft, and two adjustment devices are disposed on this shaft so as to rotate with it, along with two tappets that are axially displaceable on the adjustment shaft, between the adjustment devices. The tappets are firmly connected with the axially displaceable shift gate for valve switching between at least two different cam profiles of a cam package that is axially displaceable on the camshaft. The face sides of the tappets that are disposed between the adjustment devices are each provided with a contour, which contours stand in a functional connection with one another by way of a guide pin or a counter contour that is attached to the adjustment device, in each instance. In this connection, the contours of the two tappets are disposed offset by 180°. By rotating the adjustment shaft, the tappets are axially displaced on the adjustment shaft by the guide pins or counter contours that slide on the contour.

The adjustment shaft is driven by the camshaft. Camshaft can be brought into engagement with the adjustment shaft by a shiftable gear mechanism. The gear mechanism is adapted to drive the adjustment shaft a defined angle by each rotation of the camshaft. Shifting of the gear mechanism is designed to allow a temporarily engagement of the gear mechanism so that gear mechanism can be brought into or out of engagement during each rotation of the camshaft. The engagement of the cam mechanism can so be limited to a single rotation of the cam shaft to drive the adjustment shaft a defined angle range for example 90° or 180°.

A first embodiment of the gear mechanism has a gear wheel on the adjustment shaft. The gear wheel is disposed so as to rotate with the shaft, but in axially displaceable manner, which gear wheel is brought into engagement with a gear segment disposed on the camshaft, by a drive disposed on the adjustment shaft, in order to rotate the adjustment shaft.

An alternative embodiment of the gear mechanism has a shift cam and a lever system. The lever system which is disposed on the adjustment shaft so as to rotate with it has at least two lever arms. The shift cam is in an axially displaceable manner disposed on the camshaft so as to rotate with it. The shift cam can be brought into engagement with the lever system to drive the adjustment shaft.

The advantage of the solution according to the invention consists in that reliable valve stroke switching between different cam contours takes place with little effort and little required construction space. Because of the controlled rotation of the adjustment shaft by way of the camshaft, and thus the compulsorily controlled displacement of the shift gate, incorrect switching positions during valve stroke switching are avoided.

In a preferred embodiment, a cam package can be disposed on the camshaft so as to rotate with it. The cam package is firmly connected with a pin in an axially displaceable manner. The pin can be brought into engagement with the insides of the gate groove of the shift gate, which groove widens counter to the direction of rotation of the camshaft.

In another embodiment, the gear segment disposed on the camshaft is disposed in such a manner that an axial displacement of the shift gate by means of the pin only takes place during engagement of the base circle profile of the camshaft with the gas exchange valve.

A spring can be disposed on the gear wheel, the spring force of which is directed counter to the displacement direction of the drive. The adjustment device can be provided with a locking device consisting of a spring and a ball.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
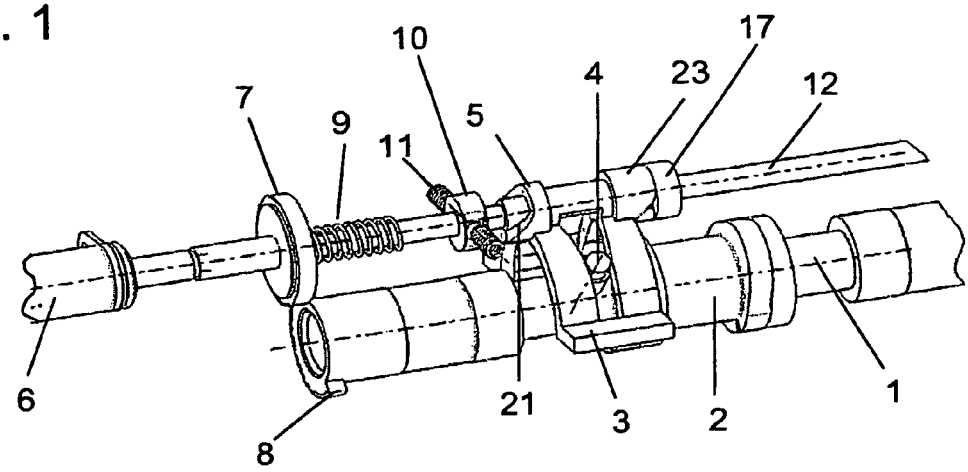
FIG. 1 shows a perspective representation of one embodiment of the invention, in which a large cam contour is active.
Figure 4:
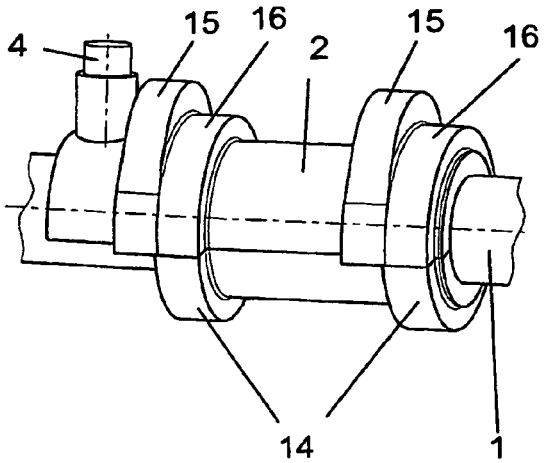
FIG. 4 shows a detail view of the camshaft with the displaceable cam segment in a switching position in which the small cam contour stands in a functional connection with a gas exchange valve.
Figure 5:
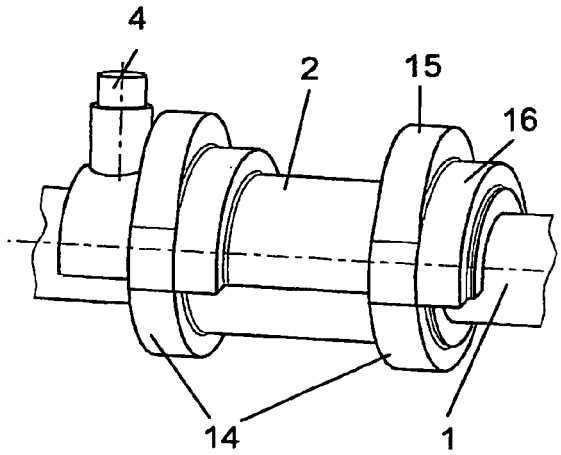
FIG. 5 shows a detail view of the camshaft with the displaceable cam segment in a switching position in which the large cam contour stands in a functional connection with a gas exchange valve.

Referring now in detail to the drawings, the valve drive according to one embodiment of the invention is shown in FIG. 1, for activation of gas exchange valves, and consists of a camshaft 1 driven by a crankshaft of the internal combustion engine, with an adjustment shaft 12 for activating valve stroke switching between two different cam profiles 15, 16 disposed parallel to it. In this embodiment, adjustment of two valves of a cylinder takes place. An application of the invention can also be used for multiple cylinders. A cam package 2 is mounted in an axially displaceable manner in camshaft 1, so as to rotate with it. Cam package 2 consists of four cams, of which each set of two adjacent cams have a large cam profile 15 and a small cam profile 16. Cam package 2, as shown in FIGS. 4 and 5, can be structured to be divided in the axial direction, whereby the cam part that consists of base circle profiles 14 is firmly connected with camshaft 1, and the cam part provided with the cam parts having cam profiles 15, 16 is displaceable relative to the firmly disposed base circle profiles 14. FIG. 4 shows a switching position in which each small cam profile 16 stands in a functional connection with the gas exchange valves. In this switching position, small cam profile 16 is above base circle profile 14. FIG. 5 shows a switching position in which the gas exchange valves are activated by large cam profiles 15. In order for a precise end switching position to be achieved, a catch element, which is known but not shown, is disposed between the displaceable cam part and camshaft 1.

It is also possible to configure cam package 2 as a component that is connected with camshaft 1 so as to rotate with it, but in an axially displaceable manner on it. In this configuration, it is necessary for each of large cam profile 15 and small cam profile 16 to be provided with a uniform base circle profile 14.

A pin 4 is firmly disposed on axially displaceable cam package 2, which pin can be brought into engagement with the inside surface of a widening gate groove 20 of an axially displaceable shift gate 3 for displacing cam package 2. Shift gate 3 partly surrounds camshaft 1 and is provided with a gate groove 20 that widens counter to the direction of rotation of camshaft 1. Pin 4 passes through gate groove 20 of shift gate 3 during every revolution of camshaft 1. In this connection, pin 4 is disposed on cam package 2 in such a manner that the axis of pin 4 is disposed in accordance with a switching position that is appropriate for the phase of the base circle 14, as shown in FIGS. 4 and 5.

A tappet 5, 23 is firmly connected on both sides of the circumference of shift gate 3. Tappets 5, 23 are mounted to be axially displaceable on adjustment shaft 12. A contour 21 is disposed on the face side of tappet 5 that lies on the outside, and a contour 22 is disposed on the face side of tappet 23 that lies on the outside. The two tappets 5, 23 are disposed on adjustment shaft 12, between two adjustment devices 10, 17 that are disposed on adjustment shaft 12 so as to rotate with it. A guide pin 18 is firmly disposed on adjustment device 10, which pin connects with contour 21 of tappet 5. A guide pin 24 is firmly disposed on the adjustment device 17, which pin connects with contour 22 of tappet 23. The engagement of guide pin 18 of adjustment device 10 on contour 21 of tappet 5 is disposed offset by 180° relative to the engagement of guide pin 24 of adjustment device 17 on contour 22 of tappet 23. In this connection, either the axes of guide pins 18, 24 can lie in one axis direction and contours 21, 22 are offset by 180° relative to one another, or contours 21, 22 are disposed identically and guide pins 18, 24 are offset by 180° relative to one another.

A gear wheel 7 is mounted on adjustment shaft 12 so as to rotate with it, but in an axially displaceable manner. In order to displace gear wheel 7 on adjustment shaft 12 counter to the spring pressure of a spring 9, gear wheel 7 is connected with a drive 6 that moves an adjustment bolt 19 out when activated. After activation of drive 6, the axially displaceable gear wheel 7 engages into a gear segment 8 that is situated on camshaft 1. This gear segment 8 extends on camshaft 1 over an angle range of 180° if two gas exchange valves are activated, and is disposed in such a manner that a displacement of tappets 5, 23 takes place only if pin 4 is situated outside of gate groove 20. If multiple gas exchange valves of additional cylinders, for example two, are activated by a cam star, gear segment 8 would extend only over an angle range of 90°.

Figure 6:
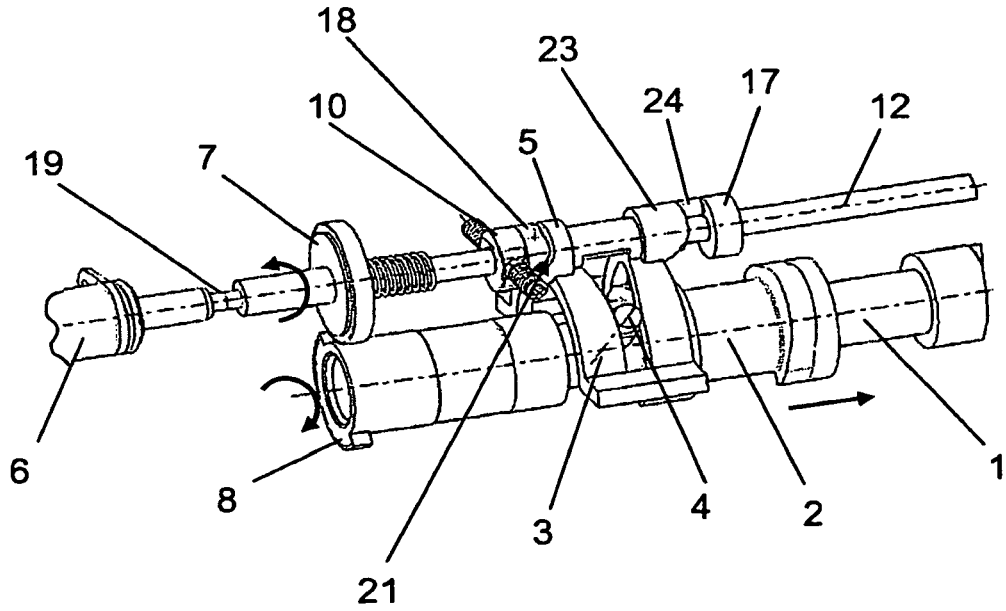
FIG. 6 shows a perspective representation of the solution according to the invention, during an activated switch between the cam profiles.

Adjustment of cam package 2 for valve stroke switching between two different cam profiles 15, 16 takes place as follows: FIG. 6 shows a valve drive in which the switching process of engagement of small cam profile 16 with the gas exchange valves to large cam profile 15 was activated by starting up drive 6. Cam package 2 is in the position shown in FIG. 4 before the switching process is initiated. During the adjustment process, gear wheel 7 is displaced on adjustment shaft 12 by adjustment bolt 19, so that it engages gear segment 8 situated on camshaft 1. Displacement of gear wheel 7 only occurs if it has been assured that no engagement of the gear wheel 7 with gear segment 8 can take place during the actual displacement process. Before gear wheel 7 engages gear segment 8, pin 4 runs through gate groove 20 in shift gate 3, without touching the inside walls of gate groove 20 while doing so. With the engagement of gear wheel 7 into gear segment 8, rotation of adjustment shaft 12 by camshaft 1 takes place. FIG. 6 shows the direction of rotation of adjustment shaft 12 and of camshaft 1 and the displacement direction of cam package 2 for this example.

Figure 7:
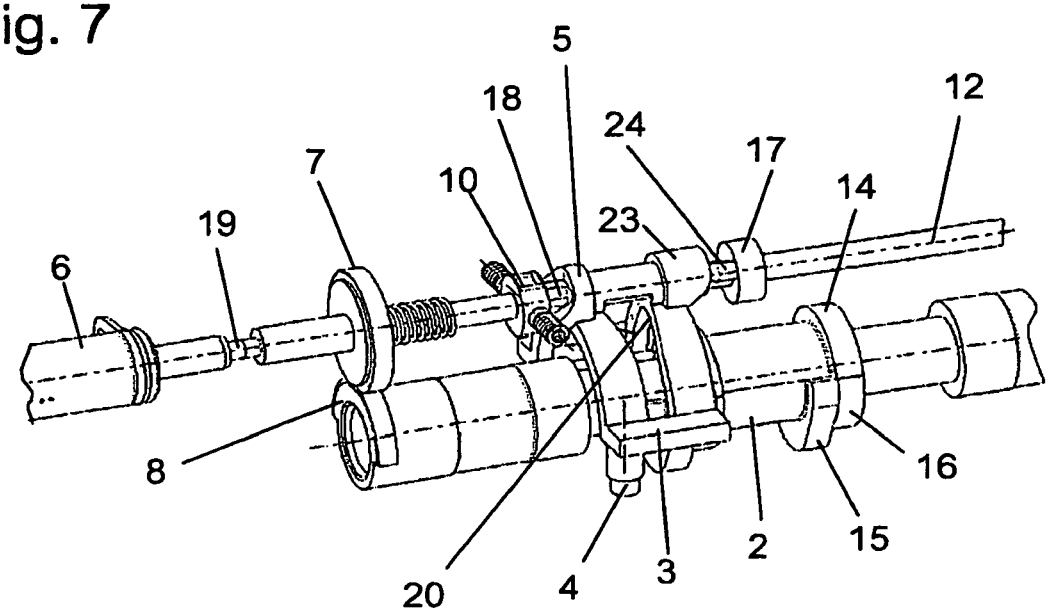
FIG. 7 shows a perspective representation of the solution according to the invention, in an intermediate position during a switch between the cam profiles.
Figure 8:
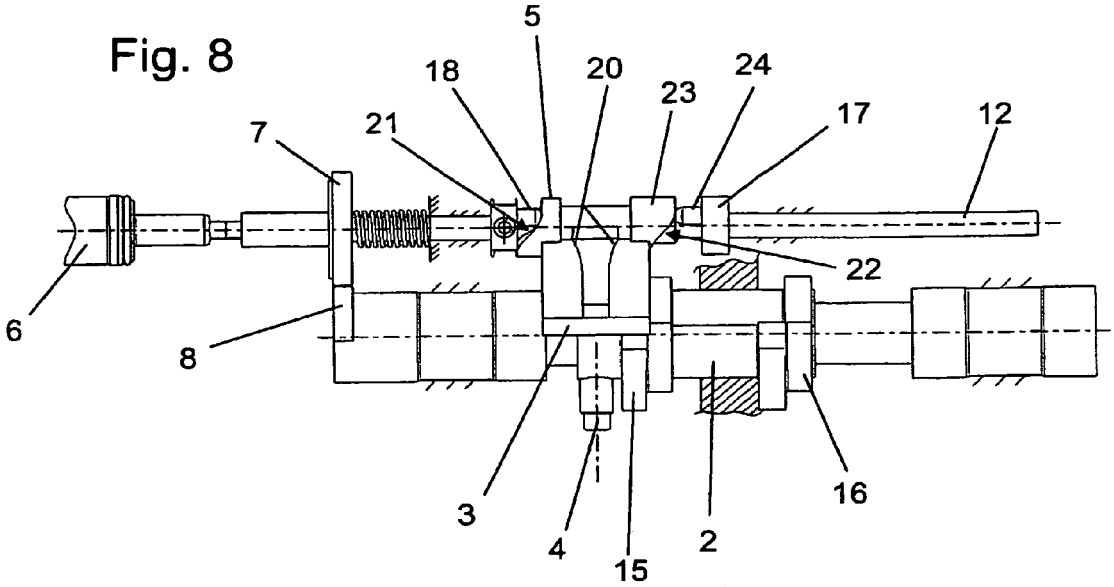
FIG. 8 shows a front view according to FIG. 6.
Figure 9:
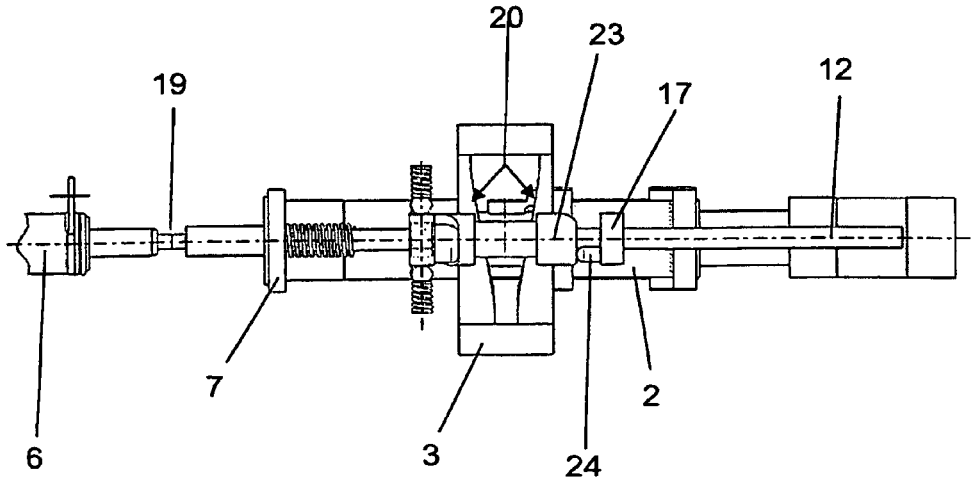
FIG. 9 shows a view from above according to FIG. 6.

FIG. 7 shows an intermediate position of the valve stroke switching by adjustment shaft 12. Because of the rotation of adjustment shaft 12, at the same time, adjustment devices 10, 17 disposed on adjustment shaft 12 so as to rotate with it are rotated, and thus guide pins 18, 24 firmly disposed on these devices are rotated. Since guide pins 18, 24 are connected with contours 21, 22 of tappets 5, 23 that are each disposed offset by 180°, axial displacement of the two tappets 5, 23 on adjustment shaft 12, in the direction of adjustment device 17, takes place. At the same time, axial displacement of shift gate 3 by tappets 5, 23 takes place. FIG. 8 shows a side view according to FIG. 7, and FIG. 9 shows the related top view. In FIG. 8, the interaction of guide pins 18, 24 with contour 21, 22 of the tappets 5, 23, respectively, can be clearly seen. In this connection, contours 21, 22 of tappets 5, 23 are disposed in such a manner that switching of switch gate 3 in accordance with the phase takes place.

Figure 2:
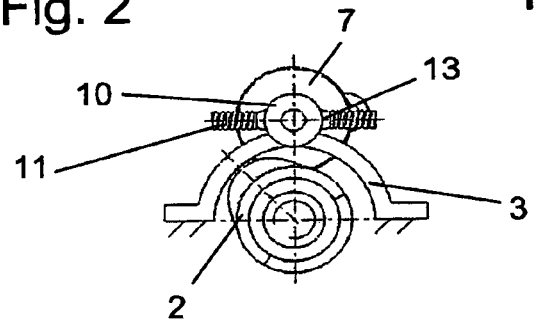
FIG. 2 shows a side view from the right according to FIG. 1.
Figure 3:
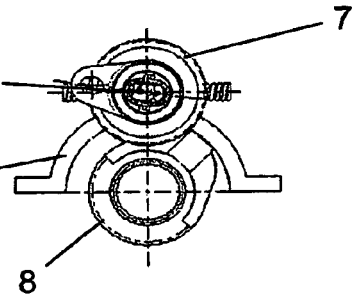
FIG. 3 shows a side view from the left according to FIG. 1.

After engagement of gear wheel 7 with gear segment 8 has taken its course, adjustment devices 10, 17 have been rotated so far that guide pin 18 lies against the highest point of contour 21, and guide pin 24 lies against the lowest point of contour 22. The displacement of tappets 5, 23 has been concluded. In order to prevent adjustment shaft 12 from being turned further, a locking device is disposed on adjustment device 10 or 17. The locking device consists of a spring 11 and a ball 13, which engages into a corresponding depression disposed in adjustment device 10 or 17. In FIG. 2, balls 13 engaged into the depression of adjustment device 10 can be seen. At the same time, drive 6 is deactivated, and gear wheel 7 is moved out of the engagement region of gear segment 8 by the spring force of spring 9 that acts counter to the adjustment direction of drive 6. In FIG. 1, this position is shown with gear wheel 7 already pushed back.

During displacement of shift gate 3 by tappets 5, 23, the pin 4 that is firmly disposed on cam package 2 is situated outside of the region of gate groove 20 that widens counter to the direction of rotation of camshaft 1, as shown in FIG. 7. By further rotation of camshaft 1, pin 4 meets the left inside surface of gate groove 20 at its widest point. As a result of the rotational movement of camshaft 1, pin 4 migrates along the left inside of gate groove 20. Because gate groove 20 narrows in the direction of rotation of camshaft 1, pin 4 and thus the axially displaceable cam package 2 are displaced to the right, until large cam profile 15 lies above the corresponding base circle profile 14, as shown in FIG. 5. By means of a locking device disposed between camshaft 1 and the displaceable cam package, cam package 2 is locked in place in the newly achieved switching position. Because of the placement of shift gate 3 and pin 4, a displacement of cam package 2 and thus valve stroke switching only take place if base circle profile 14 of camshaft 1 is connected to a gas exchange valve.

Reverse adjustment takes place analogous to the above description, whereby tappets 5, 23 are displaced in the direction of adjustment device 10 by guide pins 18, 24 that connect with contours 21, 22.

Figure 10:
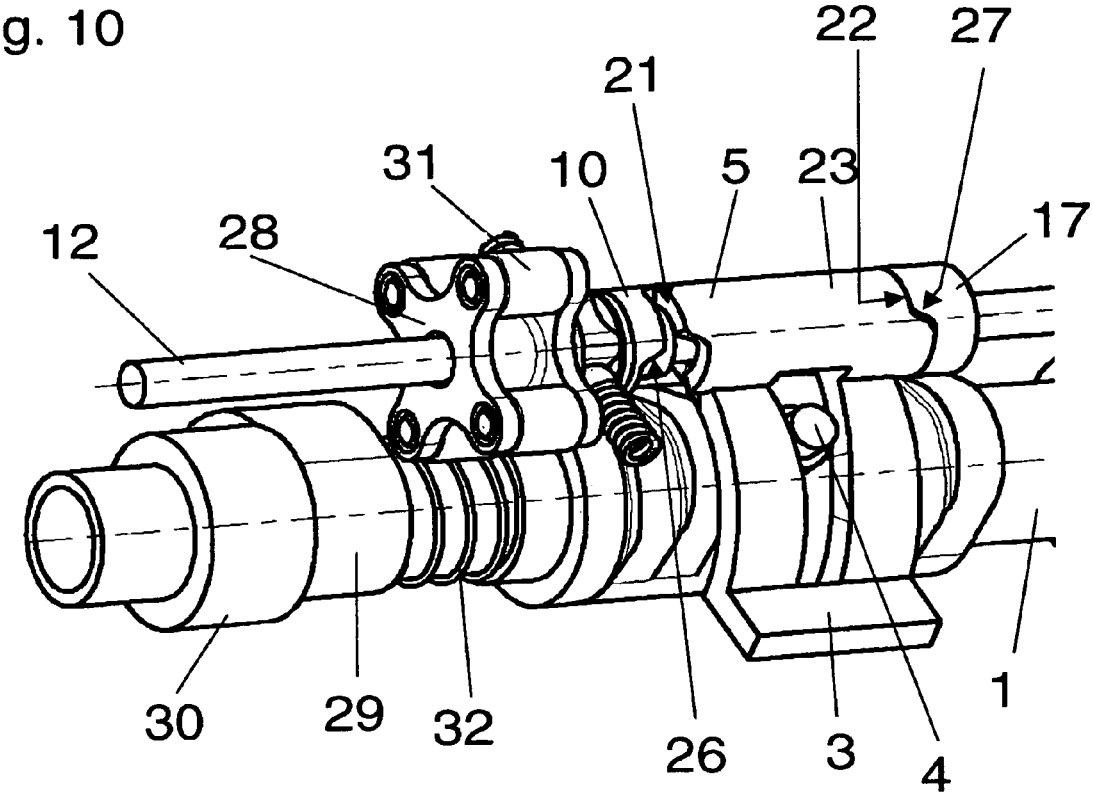
FIG. 10 shows a perspective representation of an alternative embodiment of the invention having an alternative gear mechanism to drive the adjustment shaft.
Figure 11:
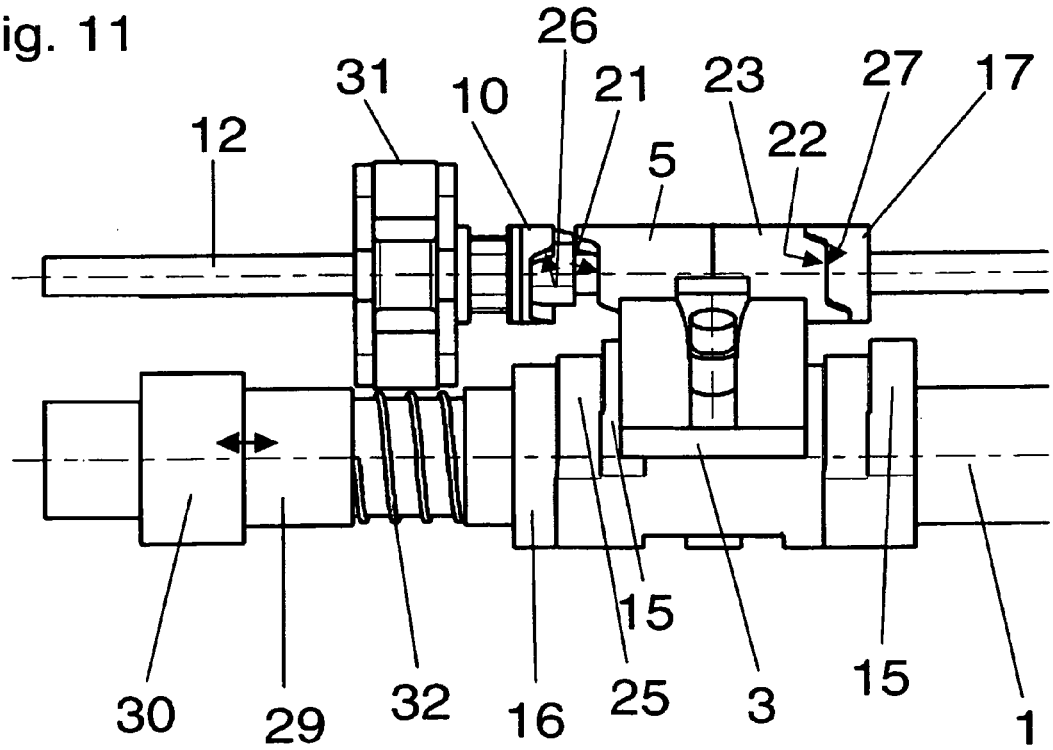
FIG. 11 shows a front view according to FIG. 10.
Figure 12:
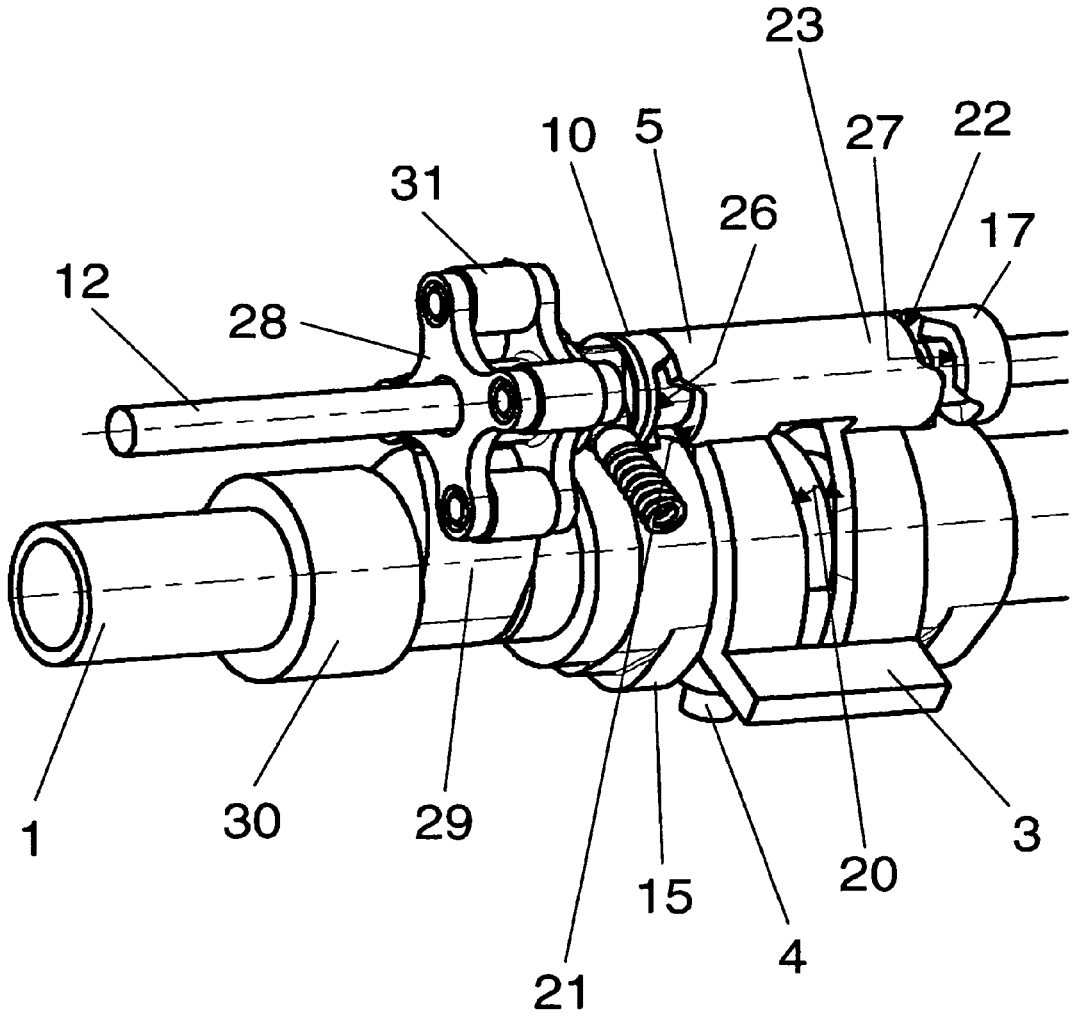
FIG. 12 shows a perspective representation of the alternative embodiment of the invention during an activated switch between the cam profiles.

FIGS. 10, 11 and 12 show a second embodiment of the invention, wherein similar reference characters denote similar elements throughout the several embodiments.

Cam package 2 consists of three different cam profiles, the small cam profile 16, the large cam profile 15 and a middle-sized cam profile 25 which is located between the large 15 and the small cam profile 16. A valve stroke switching between three different valve strokes caused by the different cam profiles 15, 16, 25 can be realized.

A tappet 5, 23 is firmly connected to both sides of the circumference of shift gate 3. Tappets 5, 23 are mounted on adjustment shaft 12 and adapted to be axially displaceable on adjustment shaft 12. Tappets 5, 23 can be designed integrally as shown in FIG. 10 or can be separate tappets 5, 23 as shown in FIG. 11.

The tappets 5, 23 are disposed on adjustment shaft 12, between two adjustment devices 10, 17. Differing from the first embodiment, where guide pins connecting adjustment devices 10, 17 and tappets, are counter contours 26, 27 disposed on the face side of the adjustment devices 10, 17 so as to rotate with them. Counter contour 26 is disposed on the face side of adjustment device 10 opposite of contour 21 disposed on the face side of tappet 5. Adjustment device 10 and tappet 5 are mechanically linked by contour 21 and counter contour 26. Analogous to adjustment device 10 is a counter contour 27 disposed on the face side of adjustment device 17 opposite of contour contour 22, disposed on the face side of tappet 23. It is a preferred embodiment to link adjustment devices 10, 17 with tappets 5, 23 via contours 22, 23 and counter contours 26, 27. An alternative embodiment has a link via guide pins 18, 24 disposed on adjustment devices 10, 17, as described in FIGS. 6 and 7. Another—not shown—alternative embodiment has guide pins 18, 24 disposed on tappets 5,23 and linked with adjustment devices 10, 17 where counter contours 26, 27 are disposed on their face sides.

Adjustment shaft 12 is driven by camshaft 1 which can be shiftable linked with the adjustment shaft 12 by a gear mechanism. The gear mechanism consists of a lever system 28 which is disposed on the adjustment shaft 12 so as to rotate with it and a shift cam 29. The shift cam 29 is in an axially displaceable manner disposed on the camshaft 1 so as to rotate with it. The shift cam 29 can, depending on its axial position on the cam shaft 1, be linked mechanically with the lever system 28 to drive the adjustment shaft 12. In another—not shown—embodiment is the lever system 28 axially displaceable disposed on the adjustment shaft 12 and shift cam 29 has a fixed axial position on cam shaft 1.

FIGS. 10 and 11 show the gear mechanism in its inactive state where shift cam 29 and lever system 28 are unengaged. In this inactive state is the adjustment shaft 12 not driven by camshaft 1 in standstill. Tappets 5 and 23 keep their position without rotation of the adjustment devices 10,17.

Shift cam 29 can be actuated by actuator 30 which can axially displace the shift cam 29 on camshaft 1.

The possible axial displacement of shift cam 29 is illustrated by a double arrow in FIG. 11. The axial displacement towards its engaged position with the lever system 28 is caused by actuator 30 whereby the reverse movement into its inactive state is supported by spring 32.

The lever system 28—shown in FIGS. 10, 11 and 12—consists in this embodiment of a system of four interconnected levers arranged around a central hub, whereby each lever supports a pivotably mounted roller 31 supported on the end of each lever. In another embodiment are, instead of the rollers 31, slide faces (not shown) supposed on the end of each lever.

The shift cam 29 is mounted on cam shaft 1 so as to rotate with it, but in an axially displaceable manner. In order to displace shift cam 29 on cam shaft 1, counter to the spring pressure of spring 32, shift cam 29 is driven by actuator 30 that drives shift cam 29 axially on camshaft 1. After activation of actuator 30, the axially displaceable shift cam 29 engages into a lever of the lever system 28 that is firmly disposed on adjustment shaft 12.

Adjustment of cam package 2 for valve stroke switching between the different cam profiles 16, 25 and 15 takes place as follows: FIG. 12 shows a valve drive in which the switching process of engagement of medium sized cam profile 25 with the gas exchange valves to large cam profile 15 was activated by starting up actuator 30. Cam package 2 is in the position before the switching process is initiated. During the adjustment process, shift cam 29 is displaced on adjustment shaft 12 by actuator 30, so that it engages lever system 28 situated on adjustment shaft 12. Before shift cam 29 engages lever system 28, pin 4 runs through gate groove 20 in shift gate 3, without touching the inside walls of gate groove 20 while doing so. With the engagement of shift cam 29 into lever system 28, rotation of adjustment shaft 12 by camshaft 1 takes place. Shift gate 3 is positioned by displacement devices 10,17 where counter contours 26, 27 face the contours 21, 22 of tappets 5, 23 as described in detail above. The profile of contours 21, 22, counter contours 26, 27 and their position to each other define the axial position of tappets 5, 23.

The lever system 28 has four lever arms equally spaced around the central hub. The lever system 28 is adapted to rotate adjustment shaft 90° by each rotation of the cam shaft preferably for shifting three different cam profiles. An alternative embodiment of the lever system 28 has two lever arms equally spaced to rotate adjustment shaft 180° by each rotation of the shift cam 29.

The design of the shift element as a shift cam 29 is a preferred embodiment. The shape of the shift element can vary. It has to be adapted to drive the lever system to rotate adjustment shaft.

Accordingly, while only a few embodiments of the present invention have been shown and described, it is obvious that many changes and modifications may be made thereunto without departing from the spirit and scope of the invention.

1 camshaft
2 cam package
3 shift gate
4 pin
5 tappet
6 drive
7 gear wheel
8 gear segment
9 spring
10 adjustment device
11 spring
12 adjustment shaft
13 ball
14 base circle profile
15 large cam profile
16 small cam profile
17 adjustment device
18 guide pin
19 adjustment bolt
20 gate groove
21 contour
22 contour
23 tappet
24 guide pin
25 medium-sized cam profile

26 first counter-contour
27 second counter-contour
28 lever system
29 switch cam
30 actuator
31 roller
32 spring

What is claimed is:

1. A valve drive for activation of gas exchange valves of internal combustion engines, comprising:

at least one camshaft driven by a crankshaft of the internal combustion engine;

axially displaceable cams disposed on the camshaft, said cams being connected, either directly or by way of intermediate elements, with the gas exchange valve, a shift gate disposed on a housing of the internal combustion engine, in an axially displaceable manner, said gate having a gate groove that widens counter to a direction of rotation of the camshaft, wherein said gate groove is adapted for contact with contact surfaces of displaceable cam contours of the cams, for valve stroke switching between two different cam profiles;

two tappets that are mounted on a rotating adjustment shaft, and firmly connected with the shift gate;

two adjustment devices mounted on the adjustment shaft so as to rotate with it, wherein said tappets are axially displaceable between said two adjustment devices, and face sides of the tappets that face the adjustment devices are each provided with a contour that is connected with a respective adjustment device by way of a guide pin; and a gear wheel disposed on the adjustment shaft so as to rotate with it and in an axially displaceable manner, said gear wheel adapted to be brought into and out of engagement with a gear segment that is firmly disposed on the camshaft.

2. The valve drive according to claim 1, wherein the adjustment shaft has a drive for axial displacement of the gear wheel on the adjustment shaft.

3. The valve drive according to claim 1, wherein the cams are part of a cam package disposed in an axially displaceable manner on the camshaft so as to rotate with the camshaft, said cam package being firmly connected with a pin that can be brought into engagement with insides of the gate groove of the shift gate.

4. The valve drive according to claim 3, wherein the gear segment disposed on the camshaft is disposed so that an axial displacement of the shift gate by the pin only takes place during engagement of a base circle profile of the camshaft with the gas exchange valve.

5. The valve drive according to claim 1, wherein engagement of the guide pin of one of the adjustment devices on the contour of one of the tappets is offset by 180° relative to the engagement of the guide pin of the other adjustment device on the contour of the other tappet.

6. The valve drive according to claim 2, wherein a spring is disposed on the gear wheel, a spring force of which is directed counter to a displacement direction of the drive.

7. The valve drive according to claim 1, wherein one of the adjustment devices is provided with a locking device consisting of a spring and a ball.

8. A valve drive for activation of gas exchange valves of internal combustion engines, comprising:

at least one camshaft driven by a crankshaft of the internal combustion engine;

axially displaceable cams disposed on the camshaft, said cams being connected, either directly or by way of intermediate elements, with the gas exchange valve, a shift gate disposed on a housing of the internal combustion engine, in an axially displaceable manner, said gate having a gate groove that widens counter to a direction of rotation of the camshaft, wherein said gate groove is adapted for contact with contact surfaces of displaceable cam contours of the cams, for valve stroke switching between at least two different cam profiles;

two tappets that are mounted on a rotating adjustment shaft, and firmly connected with the shift gate;

two adjustment devices mounted on the adjustment shaft so as to rotate with it, wherein said tappets are axially displaceable between said two adjustment devices, and face sides of the tappets that are in engagement with the adjustment devices are each provided with a contour that is connected with a respective adjustment device by way of a guide pin or counter contour; and a gear mechanism adapted to shift the adjustment shaft and cam shaft into and out of engagement.

9. The valve drive according to claim 8, wherein the gear mechanism rotates the adjustment shaft and consists of a lever system disposed on the adjustment shaft so as to rotate with it, and a shift cam axially displaceable disposed on cam shaft, wherein the shift cam and the lever system are adapted to be brought into and out of engagement with each other.

10. The valve drive according to claim 9, wherein the shift cam has a actuator for axial displacement of the shift cam on the cam shaft.

11. The valve drive according to claim 9, wherein the lever system consists of two or four interconnected levers arranged around a central hub, and wherein each lever has a pivotably mounted roller or sliding face at its end.

12. The valve drive according to claim 8, wherein the two tappets are designed integrally.

13. The valve drive according to claim 8, wherein the cams are part of a cam package disposed in an axially displaceable manner on the camshaft so as to rotate with the camshaft, said cam package being firmly connected with a pin that can be brought into engagement with insides of the gate groove of the shift gate.

14. The valve drive according to claim 8, wherein engagement of the counter contour or the guide pin of one of the adjustment devices on the contour of one of the tappets is offset by 180° relative to the engagement of the counter contour or guide pin of the other adjustment device on the contour of the other tappet.

15. The valve drive according to claim 8, wherein one of the adjustment devices is provided with a locking device consisting of a spring and a ball.

16. The valve drive according to claim 9, wherein the lever system has an actuator for axial displacement of the lever system on the adjustment shaft.

* * * * *